US006514100B2

(12) United States Patent
Maegawa

(10) Patent No.: US 6,514,100 B2
(45) Date of Patent: Feb. 4, 2003

(54) ELECTRICAL CONNECTING STRUCTURE FOR A FLAT CABLE AND A PLURALITY OF WIRES

(75) Inventor: Akihito Maegawa, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/909,812

(22) Filed: Jul. 23, 2001

(65) Prior Publication Data

US 2002/0016104 A1 Feb. 7, 2002

(30) Foreign Application Priority Data

Jul. 28, 2000 (JP) ..... 2000-228670

(51) Int. Cl.[7] ..... H01R 12/24
(52) U.S. Cl. ..... 439/492; 174/88 R
(58) Field of Search ..... 439/495, 492, 439/874, 656, 724, 499, 498, 731; 174/88 R

(56) References Cited

U.S. PATENT DOCUMENTS

| | | | | |
|---|---|---|---|---|
| 3,824,529 A | * | 7/1974 | Dorrell | 439/74 |
| 4,095,862 A | | 6/1978 | Hatch | |
| 4,640,562 A | * | 2/1987 | Shoemaker | 439/77 |
| 4,750,881 A | * | 6/1988 | Kikuchi et al. | 400/352 |
| 4,952,256 A | | 8/1990 | Schauer et al. | |
| 5,356,308 A | * | 10/1994 | Taba et al. | 439/495 |
| 5,934,930 A | | 8/1999 | Camps et al. | |
| 6,023,022 A | * | 2/2000 | Nnakamura | 174/88 R |

FOREIGN PATENT DOCUMENTS

| | | | |
|---|---|---|---|
| DE | 19920995 | 11/1999 | |
| EP | 0963014 | 12/1999 | |
| JP | 9-129282 | 5/1997 | |
| JP | 9-134748 | 5/1997 | |
| JP | 10-189197 | * 7/1998 | H01R/35/04 |

OTHER PUBLICATIONS

English Language abstract of –JP–9–129282.
English Language abstract of –JP–9–134748.

* cited by examiner

*Primary Examiner*—Khiem Nguyen
*Assistant Examiner*—J. F. Duverne
(74) *Attorney, Agent, or Firm*—Greenblum & Bernstein, P.L.C.

(57) ABSTRACT

The present invention provides an electrical connecting structure without taking up additional space and without increasing the number of components even when the number of conductors of flat cables, as well as connecting circuits for external cable wires, are increased. In particular, in an electrical connecting structure according to the present invention, since there are two case members that contain bus bars, the number of necessary circuits can be sufficiently increased. In addition, since the bus bar mounting surface for respective case members are mutually covered, a separate cover for covering the bus bar mounting surface is not required, so that costs are not greatly increased because of the advantage that limits the increase in the number of necessary members and facilitates assembly.

21 Claims, 10 Drawing Sheets

ELECTRICAL CONNECTING STRUCTURE FOR A FLAT CABLE AND A PLURALITY OF WIRES

BACKGROUND OF THE INVENTION

1. Field of the Invention

The present invention relates to an electrical connecting structure preferably to be used for a cable reel contained in a steering apparatus of automobiles. More specifically, it relates to a favorable electrical connecting structure even when the number of cable wires of the flat cable contained inside a stator and a rotor, etc., which are connected to the external cable wire by bus bars, is increased.

2. Background of the Invention

In the conventional construction of the cable reel 1 contained in a steering apparatus of an automobile, as shown in FIG. 7, a stator (external cylinder member) 2 which is fixed to the side of steering column is connected in a relatively rotatable manner to a rotor (internal cylinder member) 3 which is mounted in the steering wheel (handle) to interlockingly rotate with the steering wheel. Further, a flexible flat cable 5 is contained spirally in the annular hollow 4 existing between the stator 2 and the rotor 3 so that the flat cable 5 is wound or unwound in accordance with the forward and/or reverse rotation of the rotor 3 which is operated in accordance with the wheel rotation.

The flat cable 5 is composed of conductors made of copper foil etc., which are arranged in parallel and both sides of the conductor are sandwiched by insulating resin film. Further, the flat cable is electrically connected to an external cable by means of a bus bar which is insert molded into a case for connection of the conductor. Namely, as shown in FIG. 8, one end 6*a* of the conductors 6 of the flat cable 5 is electrically connected to the external cable wires 53 in the body side by means of bus bar 52 inside the case 51, which is contained in the stator 2. On the other hand, the other end 6*b* of the conductors 6 of the flat cable 5 is electrically connected to cable wires 56 in the steering wheel side by means of bus bar 55 inside of case 54 which is contained in the rotor 3.

More specifically, as shown in FIGS. 9 and 10, the bus bars 52 and 55 are fixed by molding in the internal surface of the respective case 51 and 54. Respective ends 6*a* and 6*b* being exposed parts of the conductor 6 of the flat cable 5 are connected by welding to respective ends of the bus bar 52 and the bus bar 55. The exposed core wire end of cable wire 53 and cable wire 56 are connected by welding to the other end of the bus bar 52 and the bus bar 55. After these conductor and core wires are connected by welding, the bus bar mounting surface of each case 51 and case 54 is covered with a respective cover 57 and 58. Then, the case 51 and the case 54 are connected by assembling to the stator 2 and to the rotor 3, respectively.

In conventional electrical connecting structures, however, it is very difficult to take measures to solve the problem of the increase in the number of conductors 6 of the flat cable 5 and the external cable wires 53 and 54. Namely, electric wiring systems to be provided in an automobile steering wheel have increased nowadays, besides the trend of air bags, so that the number of circuits is increasing. With one more pair of bus bars being added to obtain two pairs of bus bars, we can double the number of circuits. However, with the aforementioned conventional structure, since the case and cover become necessary for every pair, the number of the cases and covers naturally become doubled. Thus, the cost should inevitably be tremendously increased because of the multiplication of the number of members and the assembly processes. Moreover, since the required space will also necessarily increase, it is difficult to secure further assembling space for the needed increase within the very limited space available.

This problem can occur not only in the connection of the flat cable of a cable reel to a cable wire, but also in the case of a plurality of flat cables or in the case that the number of cable wires for connection is increased by multiplying the number of conductors of one flat cable.

Accordingly, an object of the present invention is to provide an electrical connecting structure without requiring additional space and an increase in the number of members even in the case where the number of conductors of the flat cable and the number of connection circuits of the external cable wire are increased.

SUMMARY OF THE INVENTION

In order to solve the aforementioned problems, the present invention provides an electrical connecting structure for connecting conductors of a flat cable to core wires of a wire cable by bus bars. The connecting structure includes a plurality of case members, at least one strip-type bus bar fixed in parallel to the respective case member. The conductor of the flat cable is connectable, for example, by welding, to one end of the bus bar, and the core wire of the cable wire is connectable, for example, by welding to the other end of the bus bar. The plurality of case members are superposed so that a bus bar mounting surface of one of said plurality of case members is covered with the other of said plurality of case members. Furthermore, an engaging mechanism that engages the respective case members is provided on each case member, and the plurality of case members is united into a single unit by the engaging structure.

The aforementioned electrical connecting structure is appropriate for a cable reel which is fixed in a steering apparatus.

Namely, a flat cable is contained in annular hollow formed by the stator and the rotor in a cable reel. Furthermore, a bus bar is fixed inside of the case for connection which is fitted in the stator and the rotor, and the conductors of the cable reel and the core wires of external cable wires are connected to opposite ends of the respective bus bars.

The case for connection which is fitted in the stator and/or rotor is formed of several case members. The case members are superposed so that a bus bar mounting surface of one of the case members is covered with another case member. An engaging mechanism that engages the respective case members is provided on each case member, and the case members are united into a single unit by the engaging structure.

With the aforementioned structure, the number of circuits can be sufficiently increased because the plurality of case members containing bus bar fixed by molding can be provided. Moreover, since the bus bar mounting surface of each respective case member is covered by the other case member, a separate cover for covering the bus bar mounting surface will not be necessary, so that an increase in the number of members and the number of assembly processes can be limited and costs will not be greatly increased. Further, since a separate cover that covers the bus bar mounting surface is not necessary, an increase in the required space for assembly can be limited. It is also easy to arrange the case because the case is united as a single compact unit by superposing all case members by the engaging mechanism provided on each case member.

More specifically, the superposing is conducted under the condition that the bus bar mounting surface of a lower case member faces upwardly, and, on the other hand, the bus bar mounting surface of an upper case member faces downwardly.

In addition, a flat cable insertion groove is provided on one side of the aforementioned case members, and cable wire insertion grooves are provided on the other side of the aforementioned case members. Since the case members are superposed on each other, the cable wire insertion grooves of both the upper case member and the lower case member are superposed and connected to each other, so that the cable wire grooves in the upper case member directly overly the cable wire grooves in the lower case member so that cable wires mounted in the upper case member directly overly cables wires mounted in the lower case member. Alternatively, the cable wire grooves in the upper case member are staggered with respect to the cable wire grooves in the lower case member, so that the cable wires mounted in the upper case member are staggered with respect to cable wires mounted in the lower case member.

In another aspect of the present invention, the aforementioned case member is superposed with the bus bar mounting surface facing upwardly in order to cover the upper surface of the uppermost case member by a cover.

In this case, even when the number of case members is two or more, a single cover (covering member) is sufficient, so that the number of members can be reduced and the space required can be limited.

The case made up of the aforementioned plurality of case members can be provided in both sides, which means the connection side of the conductors of the flat cable and the cable wires of the body side, and the connection side of the conductors of the flat cable and the cable wire of wheel (handle) side, or the case members can be provided in either side.

Further, the connection of the aforementioned bus bars and the conductors of the flat cable, and the connection of the bus bars and the core wires of the cable wire may be conducted by ultrasonic welding or resistance (spot) welding methods.

DESCRIPTION OF THE PREFERRED EMBODIMENT

Figure 1:
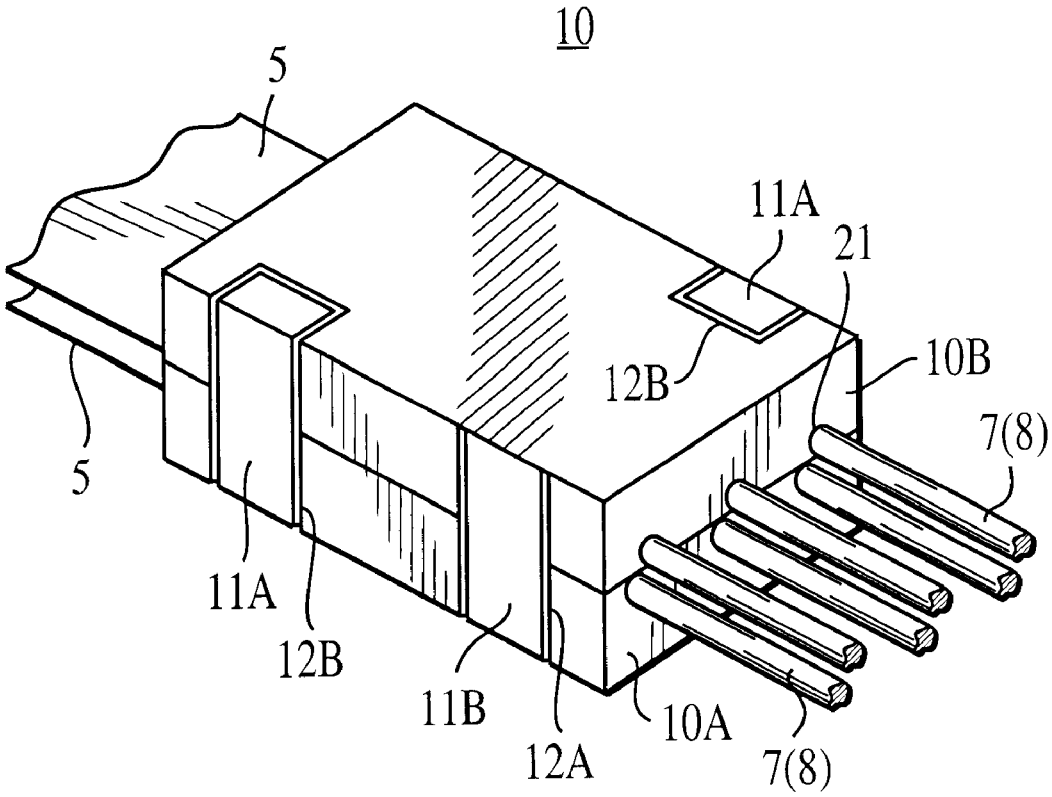
FIG. 1 is a perspective view of an assembly depicting a principal part of the electrical connecting structure according to a first embodiment of the present invention.

The present invention is further described in the detailed description which follows, by reference to the noted plurality of drawings by way of non-limiting examples of preferred embodiments of the present invention, in which like reference numerals represent similar parts throughout the several views of the drawings.

Figure 7:
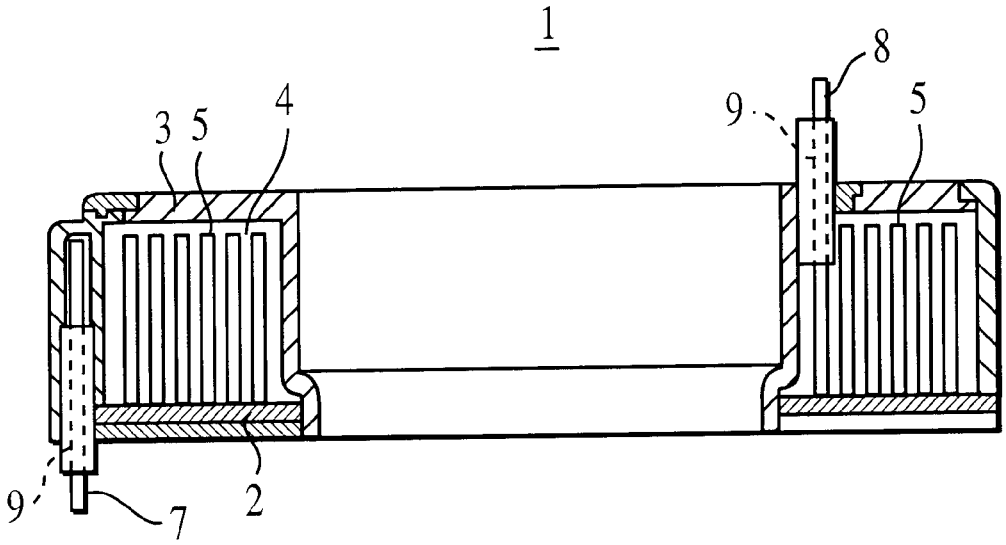
FIG. 7 PRIOR ART
FIG. 7 is a sectional view of a conventional cable reel structure.
Figure 8:
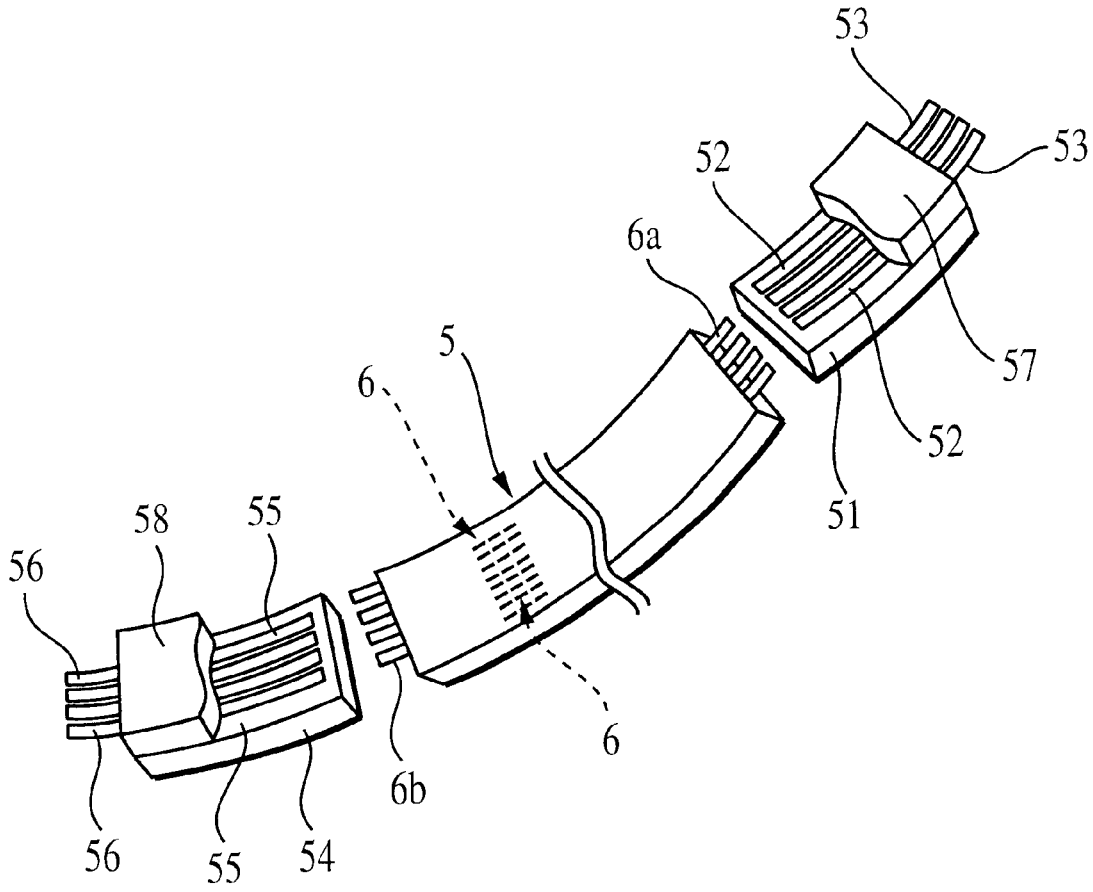
FIG. 8 PRIOR ART
FIG. 8 is a perspective view depicting the electrical connecting condition for bus bar, flat cable and wire-harness in a conventional electrical connecting structure.
Figure 9:
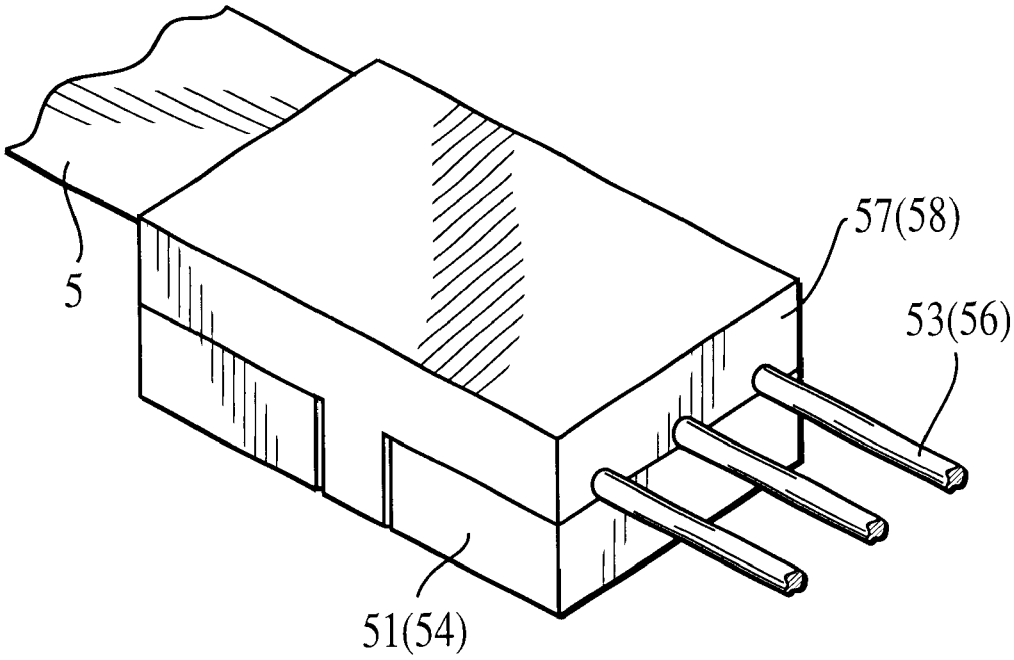
FIG. 9 PRIOR ART
FIG. 9 is a perspective view of an assembly showing the principal part of a conventional electrical connecting structure.
Figure 10:
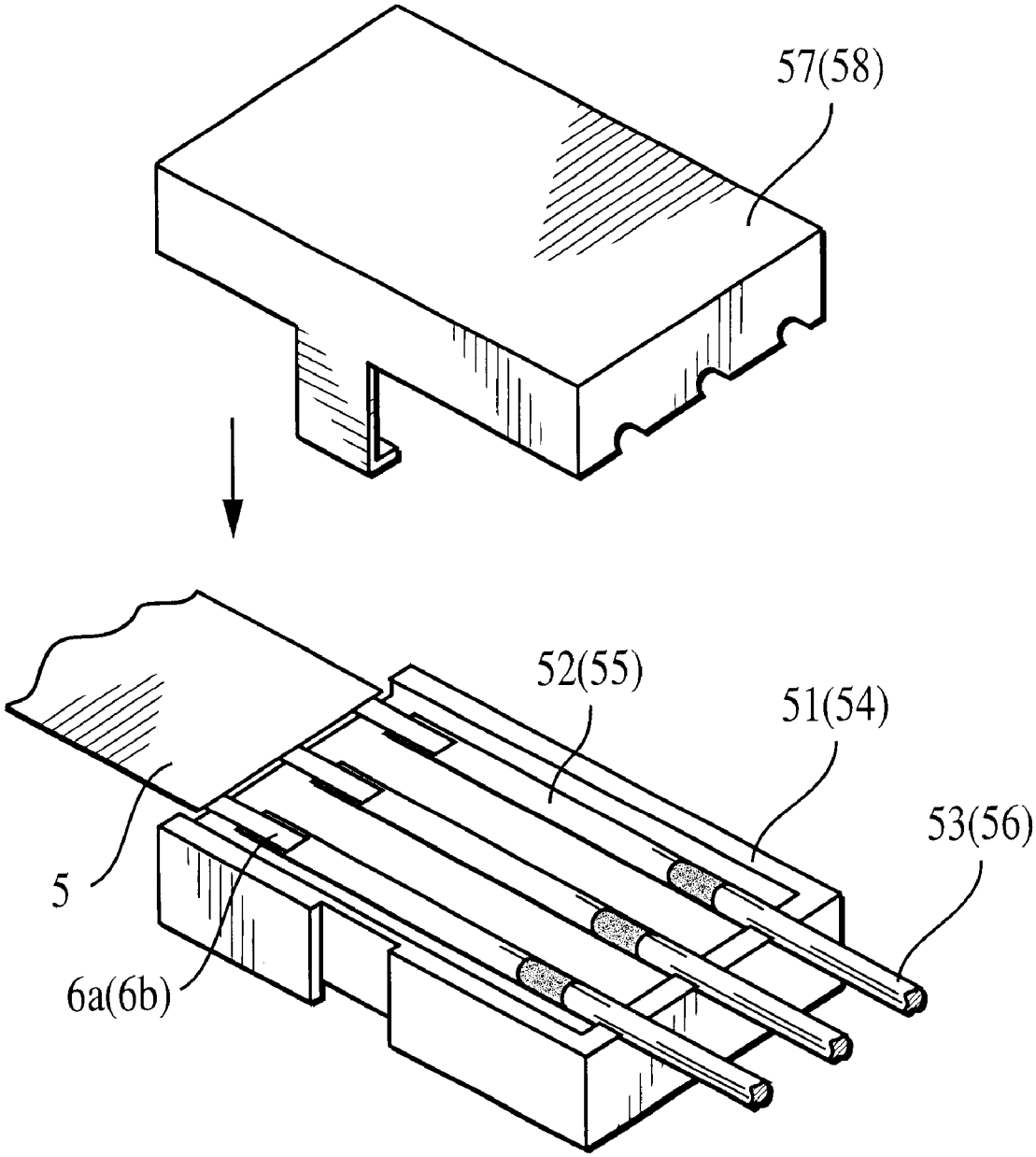
FIG. 10 PRIOR ART
FIG. 10 is a perspective view of the principal part of the conventional electrical connecting structure shown in a disassembled condition.

The construction of the cable reel to which the electrical connecting structure of the present invention is applied is the same as that of the conventional construction shown in FIG. 7. In this construction, a stator (external cylinder member) fixed inside the steering column is connected in a relatively rotatable manner to a rotor (internal cylinder member) which is mounted inside the steering wheel (handle) to interlockingly rotate with the wheel. Additionally, a flexible flat cable is contained spirally in the annular hollow existing between the stator and the rotor, so that the flat cable is wound and/or unwound in accordance with the forward and/or reverse rotation of the rotor which is operated in accordance with the wheel rotation.

Figure 2:
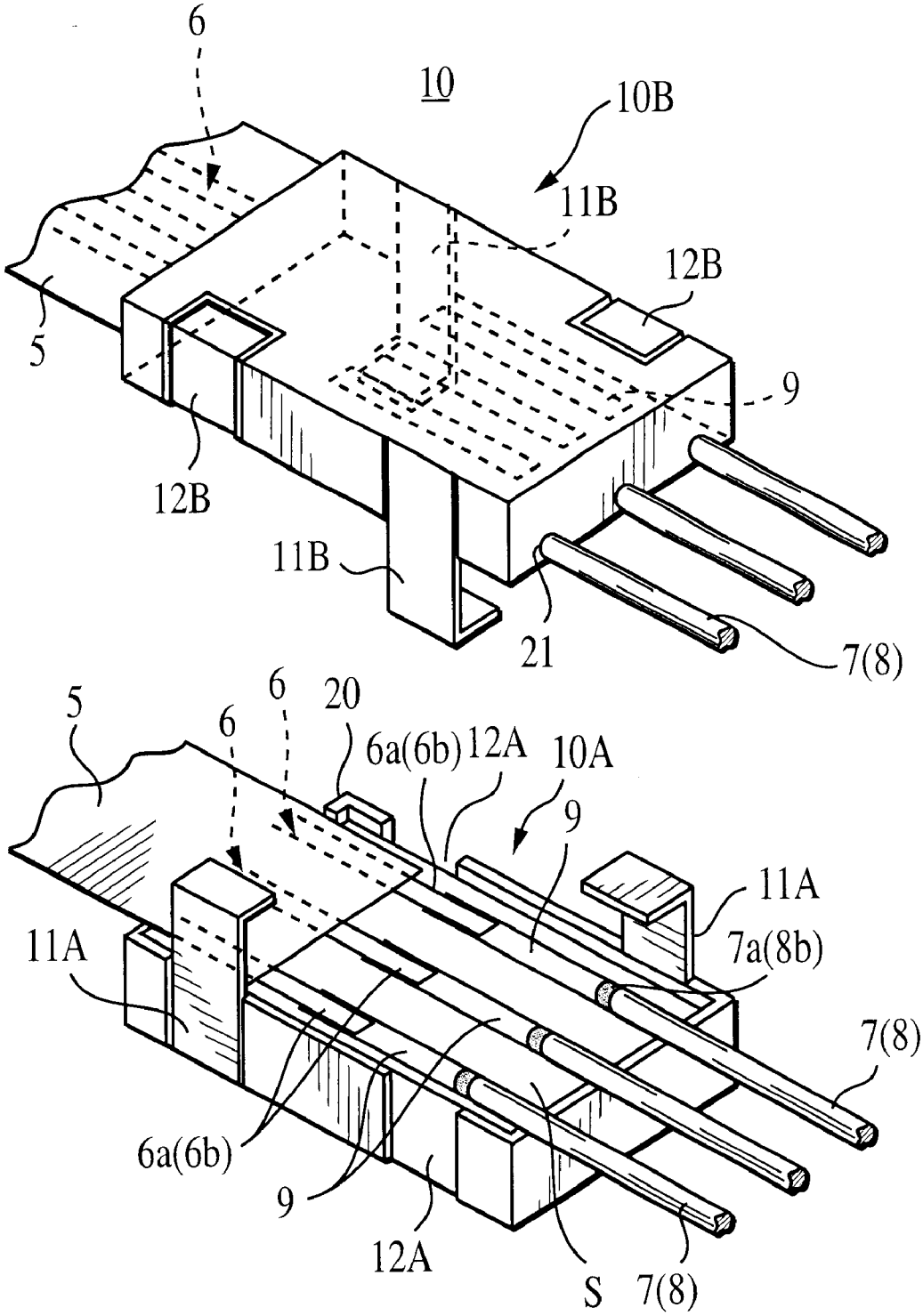
FIG. 2 is a perspective view of the principal part of the electrical connecting structure of the embodiment of FIG. 1 shown in a disassembled condition.
Figure 3:
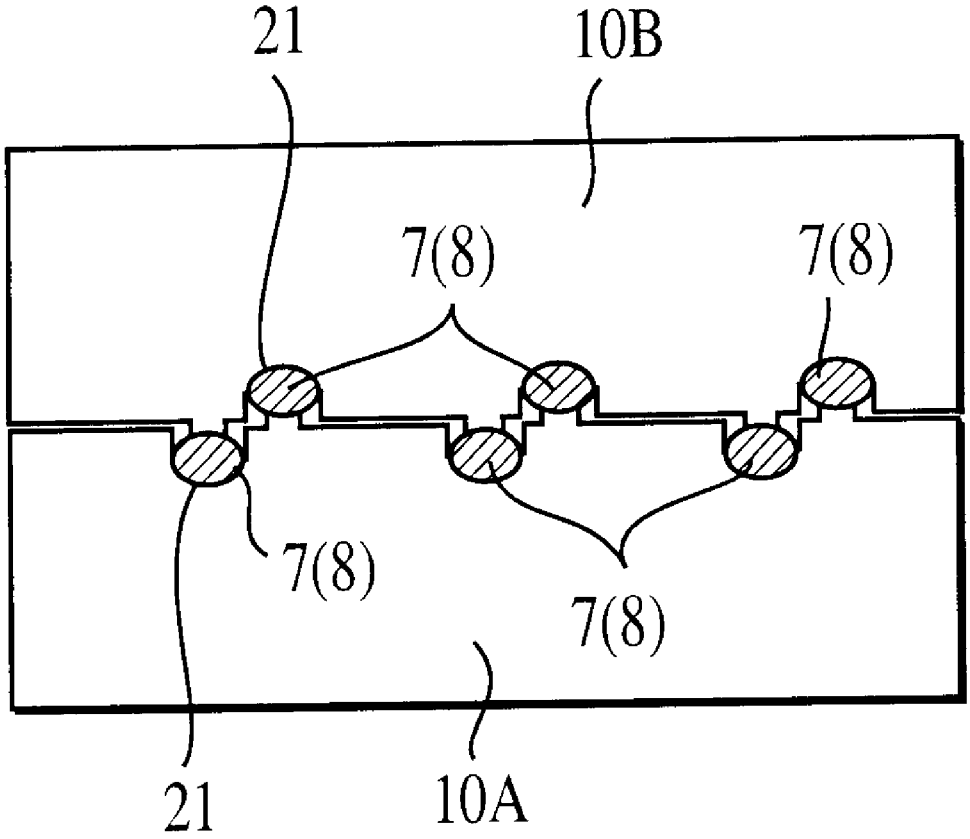
FIG. 3 is an end view showing an example of the position deviation of the cable wire of wire-harness in the electrical connecting structure of the first embodiment.

The first embodiment of the electric connecting structure of the present invention is shown in FIGS. 1 through 3. Namely, as shown in FIGS. 1 and 2, strip-shape bus bars 9 formed, for example, from metallic electro-conductive plate, are arranged in parallel in both sides, which means in the connection side of the conductor 6 of flat cable 5 and the cable wire 7 of body side, and in the connection side of the conductor 6 of the flat cable 5 and the cable wire 8 of wheel (handle) side, and then, assembled by molding, so that insulating resin case members 10A and 10B are provided. Three bus bars 9 are contained in the respective case members 10A and 10B as shown in FIGS. 1 and 2. However, the number of bus bars contained in one case is actually more than three. One end 6*a* of the conductor 6 of the flat cable 5 is connected by welding to one end of a bus bar 9 a respective case member 10A and 10B on the wheel side, and the core wire 7*a* of cable wire 7 is connected by welding to the other end of the respective bus bar 9. The end 6*b* of the conductor 6 of the flat cable 5 is connected by welding to one end of bus bar 9 of respective case member 10A and 10B in shaft side, and the core wire 8*a* of cable wire 8 is connected by welding to the other end of the respective bus bar 9. The flat cable 5 contains several strip-shape conductors 6 which are arranged in parallel along the linear direction, and an insulating resin film is laminated on both sides of the conductor 6. The ends 6*a* and 6*b* of the conductors 6 are exposed by peeling off the film on both ends of the flat cable 5 before the cable 5 is connected by welding to bus bar. The exposed end is connected by ultrasonic welding or by resistance welding in any suitable manner, such as to the bus bar 9.

The core wires 7*a* and 8*a* of the respective cable wires 7 and 8 are exposed by removing the insulating resin film from both ends. Then, the exposed part is connected to the bus bar 9 in any suitable manner, such as by ultrasonic welding or by resistance welding. The case members 10A and 10B forming the case 10 respectively contain rectangular bus bar mounting surfaces S, and the bus bars 9 with the exposed surface are fixed by molding as mentioned above. The case members 10A and 10B are superposed with respective bus bar mounting surfaces S facing each other, and are united to form a package by means of engaging parts 11A and 11B and engaging recesses 12A and 12B which provide an engagement mechanism to maintain the superposed condition.

Namely, engaging parts 11A are provided at alternate positions on respective sides of the case member 10A to vertically protrude past the bus bar mounting surface S and have ends that are bent generally at a right angle. Further, the engaging recesses 12A, in which the ends of the engaging part 11B are fitted, are provided at positions facing the respective engaging parts 11A from the respective side and bridging the front surface of the case member 10A. The engaging part 11B and the engaging recess 12B are provided on the case member 10B in the same manner.

Also, a flat cable insertion groove 20 is provided to extend from the edge of the surface on one side facing surface and intersecting at a right angle to the facing surface in which the engaging part and the engaging recess are provided, and arch-shaped cable wire insertion grooves 21 are provided at regular intervals from the edge of the surface in the other side of the facing surface. These cable wire insertion grooves 21 are arranged in a staggered manner when the case member 10A and 10B are superposed with respect to each other (note FIG. 3). After the core wires of the cable wires and the conductors of flat cable are respectively connected by, for example, welding to the opposite ends of bus bars 9 contained in the case members 10A and 10B, the case members 10A and 10B are superposed on each other and united as a package to obtain the case 10 as shown in FIG. 1.

More specifically, the respective case members 10A and 10B are overlaid by pressing with the bus bar mounting surfaces facing each other in order that the bus bar mounting surface S is covered by the other case member. By this operation, the engaging part 11A is fitted in the engaging recess 12B, and simultaneously the engaging part 11B is fitted in the engaging recess 12A so that the case members 10A and 10B are united as one package to obtain the case 10.

Furthermore, a pin (not shown) may be provided to project upright from the bus bar mounting surfaces of the respective case members 10A and 10B so that the flat cable 5 does not deviate from its linear direction, and a hole for inserting the pin is provided in the insulating resin film of the flat cable 5. In addition, since the cable wire insertion grooves 21 are arranged in a staggered manner as shown in FIG. 3, cable wires 7 and 8 are pressed by the edges of the case members 10A and 10B which form a cover, so that deviation of the position of the flat cables 5 can also be prevented.

The case 10 formed by assembling as mentioned above is fitted in respective containing recesses of the stator 2 and the rotor 3 (not illustrated).

Figure 4:
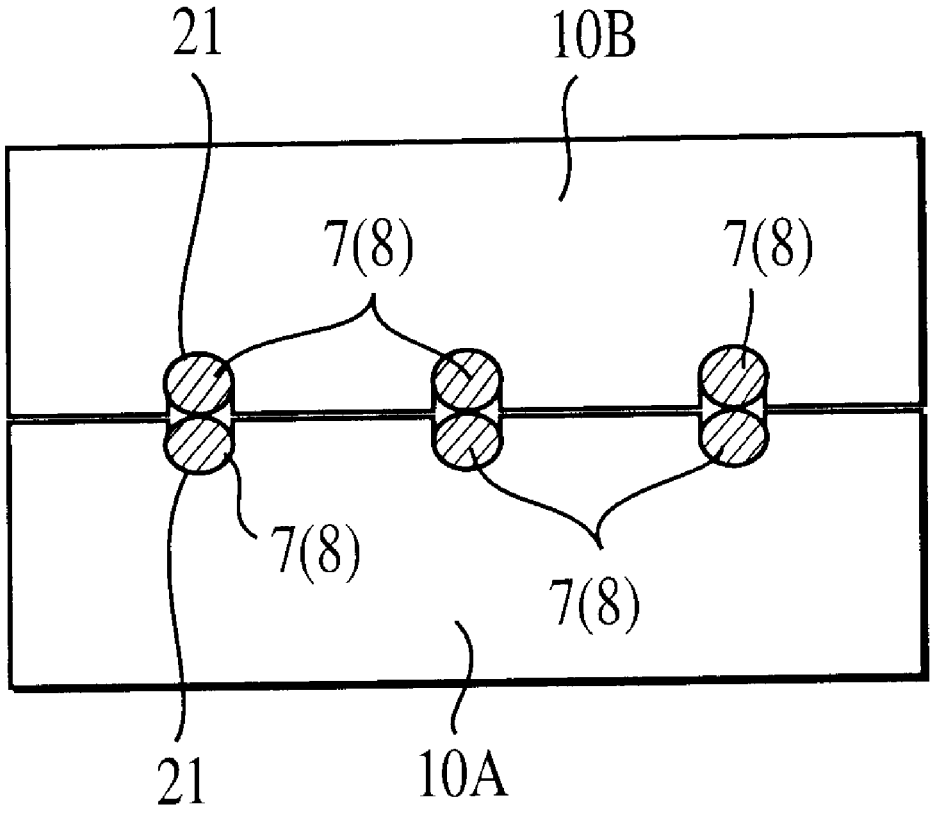
FIG. 4 is an end view showing another example of the position deviation of the cable wire of wire-harness in the electrical connecting structure of the first embodiment.

Also, the cable wire insertion grooves 21 provided in the case member 10A and 10B may be provided in an overlying manner as shown in FIG. 4 at contact position when the case members 10A and 10B are superposed with each other. In this case, the position deviation of the flat cables 5 is favorably prevented by means of the upper and lower cable wires 7 and 8 which are mutually pressed and fitted in the cable wire insertion grooves 21. In this construction, the shape of the case member 10A is identical to that of 10B so that one case member can be commonly utilized.

In addition, in the first embodiment, since the two case members 10A and 10B, are respectively interfitted at each of the flat cable 5, in the event that there are two pieces of flat cable 5, for example, one piece of the flat cable 5 can be connected to the case member 10A and the other piece of the flat cable 5 can be connected to the case member 10B. In the event that there is only one piece of flat cable 5, for example, the respective end of the flat cable 5 may be cut in two along a certain length in a linear direction, and one cut piece of the end of the flat cable 5 can be connected to the case member 10A and the other cut piece of the end of the flat cable 5 can be connected to the case member 10B.

In the electrical connecting structure of the first embodiment described above, since there are two case members 10A and 10B which contain bus bars 9, the number of circuits can be sufficiently increased. Also, since the bus bar mounting surfaces S of the respective case member 10A and 10B are mutually covered, a separate cover for covering the bus bar mounting surface S is not required, so that costs are hardly increased because the increase in the number of members and assembly process can be reduced. Further, since a separate cover for covering the bus bar mounting surface S is not required, the increase in the spaces for assembly is restricted, and simultaneously arrangement can be easily conducted since both case members 10A and 10B are superposed and united as one compact package by the engaging mechanism provided in the case members 10A and 10B.

Additionally, in the first embodiment, the number of case members in which the bus bar are contained is two. However, any desired number (more than two) of the cases can be provided, which means that the number of cases is not limited to two. Moreover, appropriate engaging mechanism can also be utilized in addition to the aforementioned engaging mechanism provided on the case members.

Figure 5:
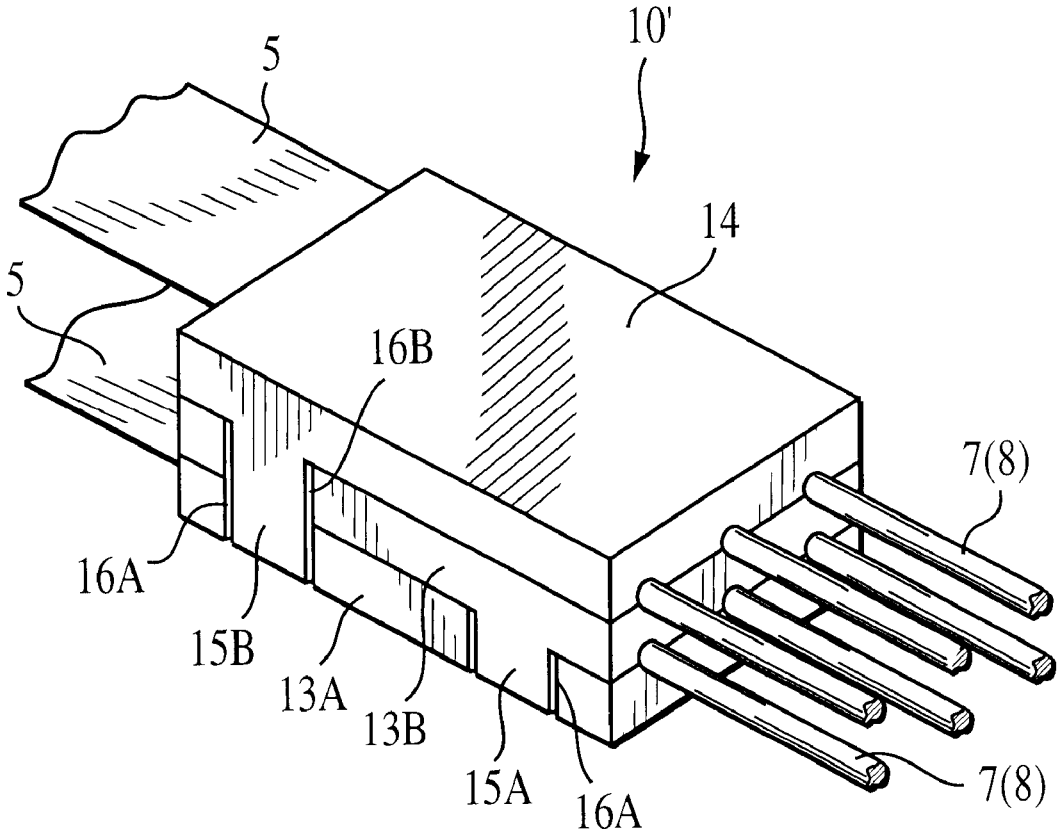
FIG. 5 is a perspective view of an assembly depicting the principal part of the electrical connecting structure according to a second embodiment of the present invention.
Figure 6:
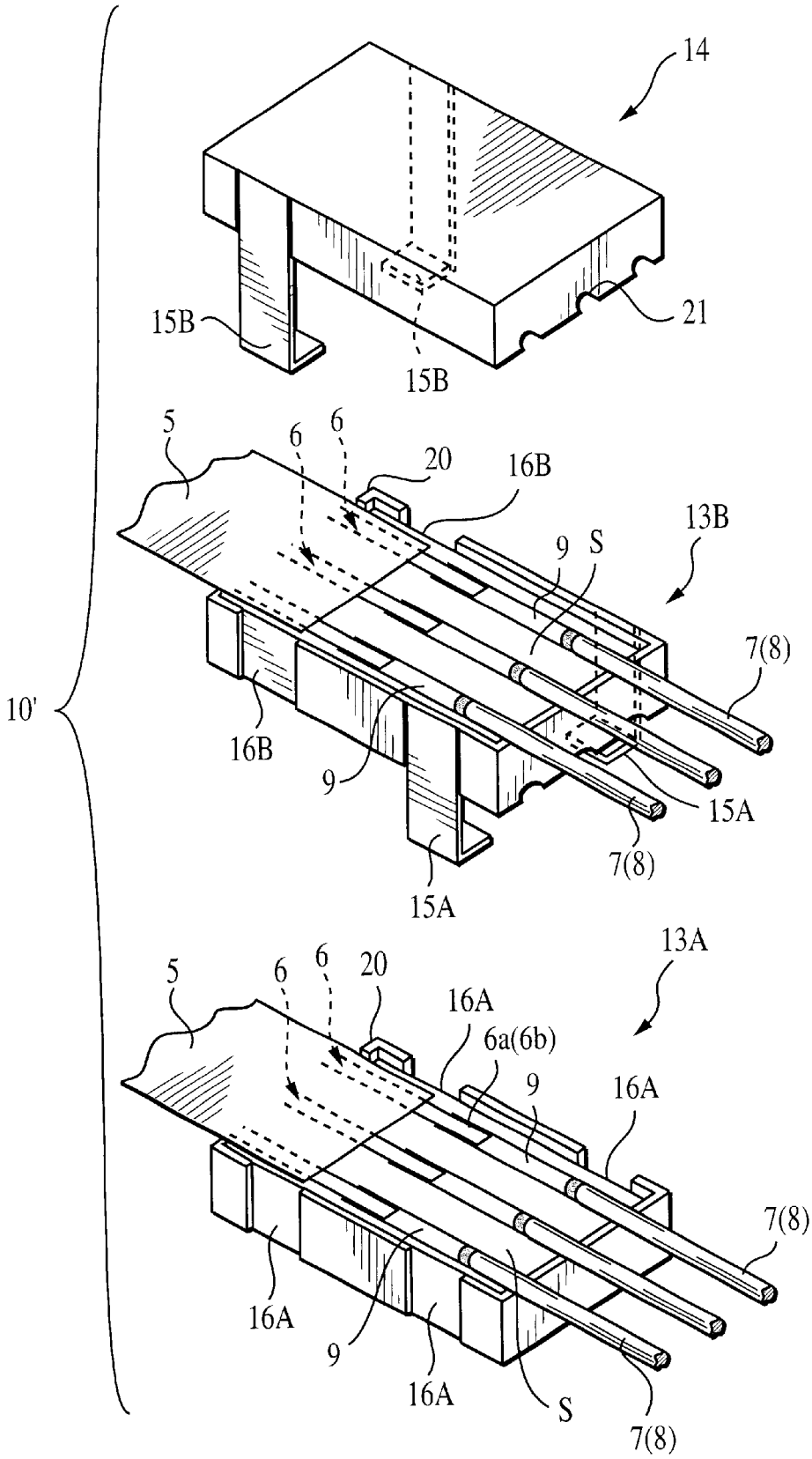
FIG. 6 is a perspective view of the principal part of the electrical connecting structure of the embodiment of FIG. 5 shown in a disassembled condition.

FIGS. 5 and 6 show a second embodiment of the present invention. In the second embodiment, the respective bus bar mounting surfaces S of the case member 13A and the case member 13B, to which respective bus bars 9 are connected by molding, face upwardly, and a cover (covering member) 14 is provided on the upper case member 13B, so that the bus bar mounting surface S of the case member 13B is covered. In comparison with the first embodiment, the extra cover 14 is further necessary in the second embodiment.

The case members 13A and 13B and the cover 14 are provided with the engaging parts 15A, 15B and engaging recesses 16A and 16B that form an engaging mechanism by which the case members and the cover are assembled and united as one package. The second embodiment is substantially identical to the first embodiment in the other elements, so that the description of the elements common to the first embodiment is omitted and only the elements different points from the first embodiment is described. The engaging part 15A which protrudes vertically above the mounting surface S and having an end bent inwardly at generally a right angle is provided at facing positions on one end of the case member 13B, and the engaging part 15B which protrudes vertically in the direction of the mounting surface S and having an end bent inwardly at generally a right angle is provided at facing positions on the other end of the respective sides of the cover 14.

Additionally, the four recesses 16A in which the ends of the engaging parts 15A and 15B are fitted are provided at positions corresponding to the respective engaging parts 15A and 15B on the respective sides bridging the front surface of the case member 13A, and the two engaging recesses 16B in which the ends of the engaging parts 15B are partially fitted are provided at positions corresponding to the respective engaging part 15B on the respective side of the case member 13B. Only the engaging part 15A is engaged with the case member 13A beneath the engaging recess 16A, however, the engaging parts 15B are engaged with both case members 13A and 13B, so that the engaging part 15B is longer than the engaging part 15A. After the conductors of the flat cable and the core wires of the external cable wire are respectively connected by, for example, welding to both ends of bus bars of the case members 13A and 13B, the case members 13A and 13B are superposed with the bus bar mounting surfaces facing upwardly, and the upper surface of the most upper case member 13B is covered by the cover 14.

Namely, as shown in FIG. 5, when the case member 13A is superposed with the bus bar mounting surface S being covered by the front surface of the case member 13B, the engaging part 15A is fitted in the two corresponding engaging recesses 16A, so that the case members 13A and 13B are united as one package. Further, when the cover 14 is superposed with the bus bar mounting surface being covered by the internal surface of the cover 14, the engaging part 15B is fitted in the two corresponding engaging recesses 16A and 16B, so that the case members 13A, 13B and the cover 14 are engaged and united as one package. The case 10', the unit made up of both case members 13A and 13B and the cover 14, is respectively interfitted on stator 2 and rotor 3 (not illustrated).

With the electrical connecting structure described in the second embodiment, since there are two case members 13A and 13B which contain bus bars 9, the number of circuits can be sufficiently increased. In addition, since the bus bar mounting surface of the case member 13A is covered by the upper case member 13B, a cover for covering the case member 13A is not required. Thus, in the case that the plural case members are superposed, only one cover 14 is necessary in comparison with the conventional structure where respective case members each need to be covered by a separate cover.

As described above, it is apparent in the electrical connecting structure of the present invention that the number of circuits can be sufficiently increased since a plurality of case members which contain bus bars are assembled in combination. In addition, since the bus bar mounting surface of a respective case member is covered with another case member, a separate cover for covering the bus bar mounting surface is not required, so that costs are not greatly increased because the increase in the number of members and assembly process can be limited. Further, since a separate cover for covering the respective bus bar mounting surface is not required, the increase in the assembly space can be limited, and simultaneously since arrangement can be easily conducted since all case members are superposed and united as one compact package by the engaging mechanism provided in the case and/or the cover. Accordingly, the appropriate measures for increasing the number (circuit number) of conductors of the flat cable and the external cable wire can be taken.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present application claims priority under 35 U.S.C. § 119 of Japanese Patent Application No. JP 2000-228670, filed on Jul. 28, 2000, the disclosure of which is expressly incorporated herein by its entirety.

What is claimed is:

1. An electrical connecting structure for connecting a conductor of a flat cable to a core wire of a wire cable through a bus bar, said electrical connecting structure comprising;

a plurality of case members, at least one strip-type bus bar being fixed in parallel to the respective case member, the conductor of the flat cable being connectable to one end of said bus bar, and the core wires of the cable wire being connectable to the other end of the bus bar;

said plurality of case members being superposed so that a bus bar mounting surface of one of said plurality of case members is covered with another of said plurality of case members; and an engaging mechanism that engages the respective case members is provided on each case member, and said plurality of case members is integrated into a single unit by said engaging mechanism;

said engaging mechanism including a first pair of engaging parts provided on opposite sides of one of said plurality of case members and a first pair of engaging recesses provided on said opposite sides of said one of said plurality of case members, a second pair of engaging recesses provided on opposite sides of another of said plurality of case members, and a second pair of engaging parts provided on opposite sides of one of said one and said another of said plurality of case members, so that said first and second pair of engaging parts are fitted in said first and second pair of engaging recesses when said plurality of case members is integrated into a single unit.

2. The electrical connecting structure as set forth in claim 1, wherein a flat cable insertion groove is provided on one side face of each respective case member, and at least one cable wire insertion groove is provided on the other side face of each respective case member; whereby, when said case members are superposed on each other, said flat cable insertion grooves on both an upper case member and a lower case member are superposed and interconnected with each other.

3. The electrical connecting structure as set forth in claim 1, wherein said engagement mechanism further includes a third pair of engagement recesses provided on opposite sides of said another of said plurality of case members, and wherein an uppermost case member of said plurality of case members is covered with a cover; and said second pair of engaging parts is provided on opposite sides of said cover.

4. The electrical connecting structure as set forth in claim 1, wherein said single unit in which said plurality of case members are integrated is interfitted in a stator and a rotor in a cable reel to be mounted on a steering apparatus; whereby, a flat cable contained in a cable reel and an external cable wire are connected to each other by said bus bar.

5. The electrical connecting structure as set forth in claim 2, wherein said cable wire grooves in said upper case member directly overly said cable wire grooves in said lower case member, so that cable wires mounted in said upper case member directly overlie cable wires mounted in said lower case member.

6. The electrical connecting structure as set forth in claim 5, wherein said engagement mechanism further includes a third pair of engagement recesses provided on opposite sides of said another of said plurality of case members, and wherein an uppermost case member of said plurality of case members is covered with a cover; and said second pair of engaging parts is provided on opposite sides of said cover.

7. The electrical connecting structure as set forth in claim 6, wherein said single unit in which said plurality of case members are integrated is interfitted in a stator and a rotor in a cable reel to be mounted on a steering apparatus; whereby, a flat cable contained in a cable reel and an external cable wire are connected to each other by said bus bar.

8. The electrical connecting structure as set forth in claim 2, wherein said cable wire grooves in said upper case member are staggered with respect to said cable wire grooves in said lower case member, so that cable wires mounted in said upper case member are staggered with respect to cable wires mounted in said lower case member.

9. The electrical connecting structure as set forth in claim 8, wherein said engagement mechanism further includes a third pair of engagement recesses provided on opposite sides of said another of said plurality of case members, and wherein an uppermost case member of said plurality of case members is covered with a cover; and said second pair of engaging parts is provided on opposite sides of said cover.

10. The electrical connecting structure as set forth in claim 9, wherein said single unit in which said plurality of case members are integrated is interfitted in a stator and a rotor in a cable reel to be mounted on a steering apparatus; whereby, a flat cable contained in a cable reel and an external cable wire are connected to each other by said bus bar.

11. The electrical connecting structure as set forth in claim 2, wherein said single unit in which said plurality of case members are integrated is interfitted in a stator and a rotor in a cable reel to be mounted on a steering apparatus; whereby, a flat cable contained in a cable reel and an external cable wire are connected to each other by said bus bar.

12. The electrical connecting structure as set forth in claim 3, wherein said single unit in which said plurality of case members are integrated is interfitted in a stator and a rotor in a cable reel to be mounted on a steering apparatus; whereby, a flat cable contained in a cable reel and an external cable wire are connected to each other by said bus bar.

13. The electrical connecting structure as set forth in claim 1, wherein said second pair of engaging parts is provided on opposite sides of said another of said plurality of case members.

14. An electrical connecting structure for connecting a conductor of a flat cable to a core wire of a wire cable through a bus bar, said electrical connecting structure comprising;

a plurality of case members, at least one strip-type bus bar being fixed in parallel to the respective case member, the conductor of the flat cable being connectable to one end of said bus bar, and the core wires of the cable wire being connectable to the other end of the bus bar;

said plurality of case members being superposed so that a bus bar mounting surface of one of said plurality of case members is covered with another of said plurality of case members; and an engaging mechanism that engages the respective case members is provided on each case member, and said plurality of case members is integrated into a single unit by said engaging mechanism;

wherein a flat cable insertion groove is provided on one side face of each respective case member, and at least one cable wire insertion groove is provided on the other side face of each respective case member; whereby, when said case members are superposed on each other, said flat cable insertion grooves on both an upper case member and a lower case member are superposed and interconnected with each other.

15. The electrical connecting structure as set forth in claim 14, wherein said cable wire grooves in said upper case member directly overly said cable wire grooves in said lower case member, so that cable wires mounted in said upper case member directly overlie cable wires mounted in said lower case member.

16. The electrical connecting structure as set forth in claim 15, wherein an uppermost case member of said plurality of case members is covered with a cover.

17. The electrical connecting structure as set forth in claim 16, wherein said single unit in which said plurality of case members are integrated is intermitted in a stator and a rotor in a cable reel to be mounted on a steering apparatus; whereby, a flat cable contained in a cable reel and an external cable wire are connected to each other by said bus bar.

18. The electrical connecting structure as set forth in claim 14 wherein said cable wire grooves in said upper case member are staggered with respect to said cable wire grooves in said lower case member, so that cable wires mounted in said upper case member are staggered with respect to cable wires mounted in said lower case member.

19. The electrical connecting structure as set forth in claim 18, wherein an uppermost case member of said plurality of case members is covered with a cover.

20. The electrical connecting structure as set forth in claim 19, wherein said single unit in which said plurality of case members are integrated is interfitted in a stator and a rotor in a cable reel to be mounted on a steering apparatus; whereby, a flat cable contained in a cable reel and an external cable wire are connected to each other by said bus bar.

21. The electrical connecting structure as set forth in claim 14, wherein said single unit in which said plurality of case members are integrated is interfitted in a stator and a rotor in a cable reel to be mounted on a steering apparatus; whereby, a flat cable contained in a cable reel and an external cable wire are connected to each other by said bus bar.

* * * * *

UNITED STATES PATENT AND TRADEMARK OFFICE

CERTIFICATE OF CORRECTION

PATENT NO. : 6,514,100 B2 
DATED : February 4, 2003
INVENTOR(S) : A. Maegawa

It is certified that error appears in the above-identified patent and that said Letters Patent is hereby corrected as shown below:

Column 9,
Line 1, "overly" should be -- overlie --.

Column 10,
Line 24, "overly" should be -- overlie --.
Line 33, "intermitted" should be -- interfitted --.

Signed and Sealed this

Eleventh Day of November, 2003

JAMES E. ROGAN
*Director of the United States Patent and Trademark Office*